United States Patent [19]

Kaiser

[11] 4,252,099

[45] Feb. 24, 1981

[54] SWITCHING ARRANGEMENT FOR REGULATION OF THE FUEL-AIR MIXTURE DELIVERED TO AN INTERNAL COMBUSTION ENGINE

[75] Inventor: Eduard Kaiser, Ditzingen, Fed. Rep. of Germany

[73] Assignee: Dr. Ing. h.c.F. Porsche Aktiengesellschaft, Fed. Rep. of Germany

[21] Appl. No.: 30,547

[22] Filed: Apr. 16, 1979

[30] Foreign Application Priority Data

Apr. 14, 1978 [DE] Fed. Rep. of Germany ..... 2816203

[51] Int. Cl.[3] ..... F02B 75/10

[52] U.S. Cl. ..... 123/446

[58] Field of Search .... 123/140 MP, 119 D, 119 DB, 123/32 EE, 119 EC, 119 EG, 179 L

[56] References Cited

U.S. PATENT DOCUMENTS

| | | | |
|---|---|---|---|
| 3,949,551 | 4/1976 | Eichler et al. | 123/179 L |
| 3,967,598 | 7/1976 | Rachel | 123/179 L |
| 4,031,866 | 6/1977 | Asano | 123/32 EE |
| 4,057,042 | 11/1977 | Aono | 123/32 EE |
| 4,084,565 | 4/1978 | Dorch | 123/119 D |
| 4,133,326 | 1/1979 | Copi et al. | 123/32 EE |
| 4,172,433 | 10/1979 | Bianchi et al. | 123/32 EE |

OTHER PUBLICATIONS

Catalog Extract from "Stribel", pp. 18, 42, 48, 24, and diagram.

*Primary Examiner*—Charles J. Myhre
*Assistant Examiner*—Raymond A. Nelli
*Attorney, Agent, or Firm*—Craig & Antonelli

[57] ABSTRACT

A switching arrangement for regulation of a fuel-air mixture delivered to an internal combustion engine by means of an oxygen-measuring sensor in an exhaust flow of an internal combustion engine which produces an electric signal which is in turn used by a control unit of the fuel injection system including the fuel supply pump and timed valve and being influenced by supplementary air valve and warm-up control is improved by simplifying the circuit arrangement through the use of an rpm relay, that can be affected by the rpm of the internal combustion engine as the only relay to control operation of the control unit and timed valve as well as the fuel pump, supplementary air valve, the warm-up control.

1 Claim, 1 Drawing Figure

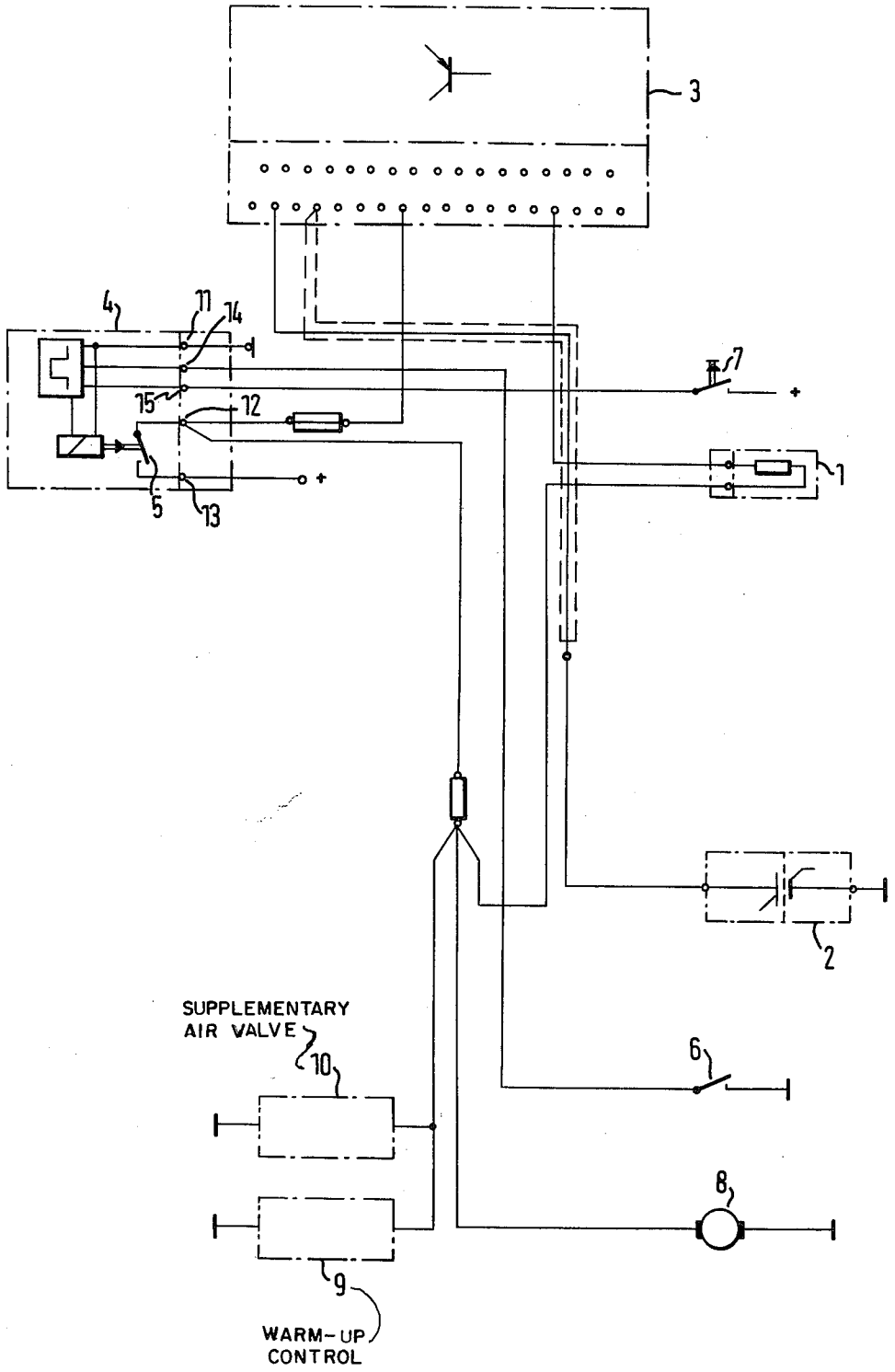
3
4
11
14
15
12
5
13
7
+
1
2
SUPPLEMENTARY
AIR VALVE
10
6
8
9
WARM-UP
CONTROL

SWITCHING ARRANGEMENT FOR REGULATION OF THE FUEL-AIR MIXTURE DELIVERED TO AN INTERNAL COMBUSTION ENGINE

BACKGROUND AND SUMMARY OF THE INVENTION

The invention relates to a switching arrangement for regulation of the fuel-air mixture delivered to an internal combustion engine by means of an oxygen-measuring sensor, disposed in the flow of exhaust gas of the internal combustion engine, which delivers an electric switching signal to the control unit of a fuel injection system as a function of the composition of the fuel-air mixture, whereby the fuel injection system is constituted by an air-measuring driveless injection system (i.e., not driven by an engine power take-off such as a drive belt) with continuous fuel flow supplied by an electric fuel pump, which system can be affected by a supplementary air valve and a warm-up control, and includes a timed valve (see, Bosch, Technical Instruction Gasoline Injection K-Jetronic, 1st issue, February, 1974).

A known switching device for regulation of the fuel-air mixture delivered by a fuel injection system of the K-Jetronic type in question, of an internal combustion engine, by means of an oxygen-measurement sensor disposed in the exhaust flow of the internal combustion engine has a main relay, and an rpm relay that is affected by the rpm of the engine. In this prior art arrangement, the control unit and the timed valve are associated with the main relay, and the electric fuel pump, the supplementary air valve and the warm-up control are associated with the rpm relay. As such, this arrangement has, in addition to the relatively high cost, a particular drawback because of the necessarily cumbersome design of the circuitry of the main relay and the rpm relay.

The present invention deals with the problem of simplifying a switching arrangement for regulation of the fuel-air mixture delivered by an air-measuring driveless injection system with continuous fuel flow, of an internal combustion engine, by means of an oxygen-measurement sensor disposed in the exhaust flow of the internal combustion engine.

According to a preferred embodiment of the invention, this problem is solved in that the switching arrangement has only a rpm relay, which is of a known type that can be influenced by the rpm of the internal combustion engine and which undertakes the control of the control unit and the timed valve in addition to its former control functions (fuel pump, supplementary air valve, warm-up control).

In particular, the advantages attained by the present invention are that, by elimination of the main relay, there is a cost-lowering simplification of the switching arrangement with an increase in reliability of operation.

These and further objects, features and advantages of the present invention will become more obvious from the following description when taken in connection with the accompanying drawings which show, for purposes of illustration only, a single embodiment in accordance with the present invention.

BRIEF DESCRIPTION OF THE DRAWING

The sole FIGURE of the drawing shows a switching arrangement, in schematic form, according to a preferred embodiment of the invention.

DETAILED DESCRIPTION OF THE PREFERRED EMBODIMENT

A timed valve 1 is associated with a fuel injection pump that is not shown in the drawing, said valve being regulated via an oxygen-measurement sensor (lambda probe) 2 and a control unit 3. An rpm relay 4 that can be influenced by the rpm of the internal combustion engine has a relay contact 5 and is connected with the breaking contact of the internal combustion engine and with an ignition element (switch) 7. This relay 4 is of the common commercial relay type used as a speedometer relay. An electric fuel pump is designated by numeral 8. A warm-up control is designated by 9 and a supplementary air valve by 10. Rpm relay 4 can be controlled via terminals 11 to 15 whose function is described below.

If the ignition of the engine is switched on by closing ignition switch 7, there is a positive voltage on terminal 15 of rpm relay 4. Terminals 11 and 13 connect to negative and positive voltages respectively. In the starting process, terminal 14 receives a negative voltage via the breaking contact in distributor 6. Relay contact 5 is closed, and control unit 3, timed valve 1, electric fuel pump 8, supplementary air valve 10 and warm-up control 9 are energized through output terminal 12. After a specific time, e.g. after two minutes, as a function of the ambient temperature, oxygen-measurement sensor 2 begins to operate and according to the composition of the exhaust gas and its temperature it regulates timed valve 1 via control instrument 3, whereby the fuel-air mixture supplied to the internal combustion engine is influenced.

It is noted that all of the components 1, 2, 3, 8, 9, and 10 are of known construction and are known for use together as part of an engine fuel-air mixture control of the K-Jetronic type noted above (and their operation is also described in U.S. Pat. No. 4,084,565), such that their construction per se forms no part of the present invention, the present invention being concerned with improving such known systems by simplifying their control circuits by eliminating the main relay, without reducing or adversely affecting the functioning of the system as a whole, with the rpm relay being of a design such that it is the only relay utilized.

While I have shown and described one embodiment in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

I claim:

1. In a switching arrangement for regulation of a fuel-air mixture delivered to an internal combustion engine by means of an oxygen-measuring sensor in an exhaust flow of the internal combustion engine which produces an electric signal to a control unit of a fuel injection system as a function of the composition of the exhaust gas developed by the combustion of the fuel-air mixture, the fuel injection system including an electric fuel supply pump, and timed valve, and being influenced by a supplementary air valve and a warm-up control, the improvement comprising an rpm relay means, constructed and arranged as part of said switching arrangement so as to be responsive to the rpm of the internal combustion engine and the only relay thereof, for controlling operation of the control unit and timed valve in addition to the fuel pump, supplementary air valve, and warm-up control.

* * * * *